US007083045B2

(12) United States Patent
Scott

(10) Patent No.: US 7,083,045 B2
(45) Date of Patent: Aug. 1, 2006

(54) MULTIPURPOSE STORAGE DEVICE

(76) Inventor: Jerry C. Scott, P.O. Box 1681, Thomasville, GA (US) 31799

( * ) Notice: Subject to any disclaimer, the term of this patent is extended or adjusted under 35 U.S.C. 154(b) by 350 days.

(21) Appl. No.: 10/329,228

(22) Filed: Dec. 26, 2002

(65) Prior Publication Data

US 2004/0188177 A1 Sep. 30, 2004

(51) Int. Cl.
*B65D 85/28* (2006.01)

(52) U.S. Cl. ..... 206/373; 248/188.8; 312/350; 312/334.7

(58) Field of Classification Search ..... 206/372, 206/373, 349; 248/188.8, 188.9; 182/129; 312/350, 334.7, 330.1, 107, 111, 319.1
See application file for complete search history.

(56) References Cited

U.S. PATENT DOCUMENTS 4,726,446 A 2/1988 Perbix ..... 182/46
5,037,027 A * 8/1991 Nichols ..... 229/198.1
5,518,118 A * 5/1996 Putz et al. ..... 206/449
5,531,326 A * 7/1996 Hummel et al. ..... 206/509
5,597,220 A * 1/1997 Domenig et al. ..... 312/334.4
6,109,709 A * 8/2000 Holcomb et al. ..... 312/218
6,368,694 B1 * 4/2002 Marsh et al. ..... 428/99

* cited by examiner

*Primary Examiner*—Shian T. Luong
(74) *Attorney, Agent, or Firm*—Richard C. McComas

(57) ABSTRACT

The present invention is a storage device ideally suited for storing a ladder or any elongated object. The storage device of the present invention comprises an elongated storage box having a front wall, rear wall, bottom wall, top wall and a pair of side walls forming a box assembly having an interior storage area. Located on the lower wall and extending beyond each side wall is a flange member that forms an inherent lip. Apertures extend though the flange and are adapted to receive conventional securing devices. This will allow for the device to be secured to any desired object, such the bed of a truck. The front wall is angled for reducing when resistance when the device is secure to a vehicle and when the vehicle is in motion. At least one additional storage compartment can be secured to any wall of the storage box for added storage capability.

1 Claim, 7 Drawing Sheets

MULTIPURPOSE STORAGE DEVICE

BACKGROUND OF THE INVENTION

1. Field of the Invention

The present invention relates generally to storage device that is designed and configured to preferably maintain, house and protect any type or model of conventional ladder and more particularly to a multipurpose storage device that includes a universal mounting means for enabling secured attachment to any conventional object, such as the outer edge of a truck's bed, frame mounts generally secured to truck's beds, or the like.

2. Description of the Prior Art

The use of a ladder is essential in many types of work. However, due to the bulky and cumbersome size of many ladders, devices have been developed to provide storage for the ladder during transportation. One such device provides for ladder storage via a rack mounted on one side of the truck bed. The ladder is then transported on the rack, thereby providing a convenient and efficient method of transporting the ladder. The prior art does not support an adjustable ladder cover compatible with all ladder styles and sizes that provides for additional storage compartments with a means for locking. Therefore, it is not surprising that numerous attempts have been made to fulfill the disadvantages of the present ladder covers.

One such example is seen in U.S. Pat. No. 4,726,446 issued to Perbix wherein disclosed is a protection cover for ladder to reduce ladder slip and electrical shock. This device is intended for use when the ladder is at full extension to minimize damage to an upright support, and minimize electrical shock by electrically insulating the ladder from the support. The cover is provided with resilient electrical non-conductive pads, which minimize movement of the upper end of the ladder. In addition, the cover is provided with a pocket structure for storage of tools and the like.

Accordingly, it is seen that there is a need for a storage device that is designed and configured to be utilized for protecting and housing any sized object and preferably one that is ideally suited for any model or sized conventional ladder. This device should includes a universal attaching element for enabling attachment to any conventional surface, such as the bed of a truck, frame mounts, or the like. In addition, the device should include various compartments for enabling other objects, such as tools or the like to be stored therein. Inherently providing a device that will provide for weatherproofing and safekeeping of any desired object.

As will be seen, the present invention achieves its intended purposes, objectives and advantages by accomplishing the needs as identified above, through a new, useful and unobvious combination of component elements. The present invention is a device is convenient and one that is simple to use, with the utilization of a minimum number of functioning parts, at a reasonable cost to manufacture, assemble, test and by employing only readily available material.

SUMMARY OF THE INVENTION

The present invention is multipurpose storage device that is designed and configured to house a plurality of objects, regards of their size and shape. Preferably, one object that is to be stored is a ladder. This will provide for the device of the present invention to be adapted to maintain, house and protect any conventional ladder, regardless of its size and/or shape. The present invention is ideally suited for transportation purposed, providing a device that will enable an individual to successful transport desired items in the storage device of the present invention, with the fear of harm, theft or the like from occurring therewith. Thereby providing a device that will inherently increase the shelf life of the particularly stored object.

In order to provide for such a multi-purpose storage device, the present invention comprises a box assembly. In the simplified embodiment, the box assembly includes a box structure having a upper wall, lower wall, side walls, a front and rear wall, which, together form the substantially box configuration.

Located on the front and/or rear wall is a door that when opened exposes the interior area of the storage device of the present invention. A lock or the like is secured thereto for enabling this front and/or rear wall to be lock and thus prevent theft from occurring. This will provide for a storage device that is elongated and is sized so as to accommodate any conventional ladder, such as a seven foot ladder, ten foot ladder, twelve foot ladder or the like.

Extending outwardly from the lower wall is a flange member. This provides for the flange member to be located to each side wall. Hence providing for two flanges, which innately form a lip. Extending through this lip is a plurality of apertures. The apertures are adapted to receive conventional attaching elements such as screws or the like. Consequently providing for the flanges, apertures and attaching elements to inherently form the attaching device for enabling the present invention to be attached to any desired surface, such as the upper edge of a truck's bed, a frame secured on a truck or the like.

To decrease wind resistance, such as when the present invention is attached to a truck or the like, the front wall is angularly attached. This arrangement will provide for front wall to be angularly disposed from the top wall to the bottom wall.

Other features can be added to enhance the box of the present invention. One feature that can be added is the use of at least one additional compartment or container. This at least one compartment or container can be located on above, below or on the side of the box assembly. Access to the compartments or container will occur via a door that can be lockable. The doors can be located on any accessible wall.

When the compartment or container is located on the side(s) of the box assembly, then the compartment will include the flange having the plurality of apertures for inherently providing for the final product to include outer side walls having a lip secured thereto.

Alternative, a plurality of compartments can be provided so as to provide for each compartment to be removably secured to a desired wall of the box assembly. In this arrangement each container will include a removably attaching device that corresponds to an attaching device located on the upper wall, side walls and/or lower wall. The attaching device can be any conventional feature.

To utilize the present invention, if provided, the user the various compartments to the box assembly, as desired by the individual. Once located thereon, the present invention is secured to the desired surface, such as the bed of a truck or the like. Once secured, the various access means of the box assembly as well as the compartments are open to render access therein. The user can store and/or retrieve any desired item. After use, each compartment is locked, including the box assembly, to provide for the items to be safe, dry and thief free.

Accordingly, it is an object of the present invention to provide for a multipurpose storage device which will overcome the deficiencies, shortcomings and drawbacks of prior store devices and methods thereof, especially those related to the storage of conventional ladders.

Another object of the present invention is to provide for a multi-purpose storage device which features the capability of storing any style or size conventional ladder in a weatherproof environment while still providing for the stored ladder to be easily accessed, retrievable and storable.

Yet another object of the present invention is an multipurpose storage device that includes a multiplicity of storage compartment that will efficiently store, maintain and protect any desired items, ultimately providing a device that enables the use to store and categorize their items via the compartment, innately providing a storage and organization element.

A further object of the present invention is to provide for a multi-purpose storage device that should enable the user to adequately and efficiently store tools and the like in individual weatherproof compartments separate from the ladder, which can be locked for controlled access. Thus, placement and retrieval of tools and the like can take place easily and quickly without the need for the user to dislodge or access the ladder.

Still a further object of the present invention is to provide for a multi-purpose storage device that meets the needs of being simple in design and relatively inexpensive to manufacture, so as to enable any homeowner, contractor or the like, from owning and utilizing such an convenient and adequate storage device.

Another object of the present invention to be specifically enumerated herein, is to provide a multipurpose storage device in accordance with the preceding objects and which will conform to conventional forms of manufacture, be of simple of construction and easy to use so as to provide for a device that would be economically feasible, long lasting and relatively trouble free in operation.

Although there exits several types of storage device none of the previous devices disclose a separate compartment for storing and maintaining a conventional ladder. The present invention meets the requirements of the simplified design, compact size, low initial cost, low operating cost, ease of installation and maintainability, and minimal amount of training to successfully employ the invention.

The foregoing has outlined some of the more pertinent objects of the invention. These objects should be construed features and applications of the intended invention. Many other beneficial results can be obtained by applying the disclosed invention in a different manner or modifying the invention within the scope of the disclosure. Accordingly, a fuller understanding of the invention may be had by referring to the detailed description of the preferred embodiments in addition to the scope of the invention defined by the claims taken in conjunction with the accompanying drawings.

BRIEF DESCRIPTION OF THE DRAWINGS

Similar reference numerals refer to similar parts throughout the several views of the drawings.

DETAILED DESCRIPTION OF THE PREFERRED EMBODIMENT

Figure 1A:
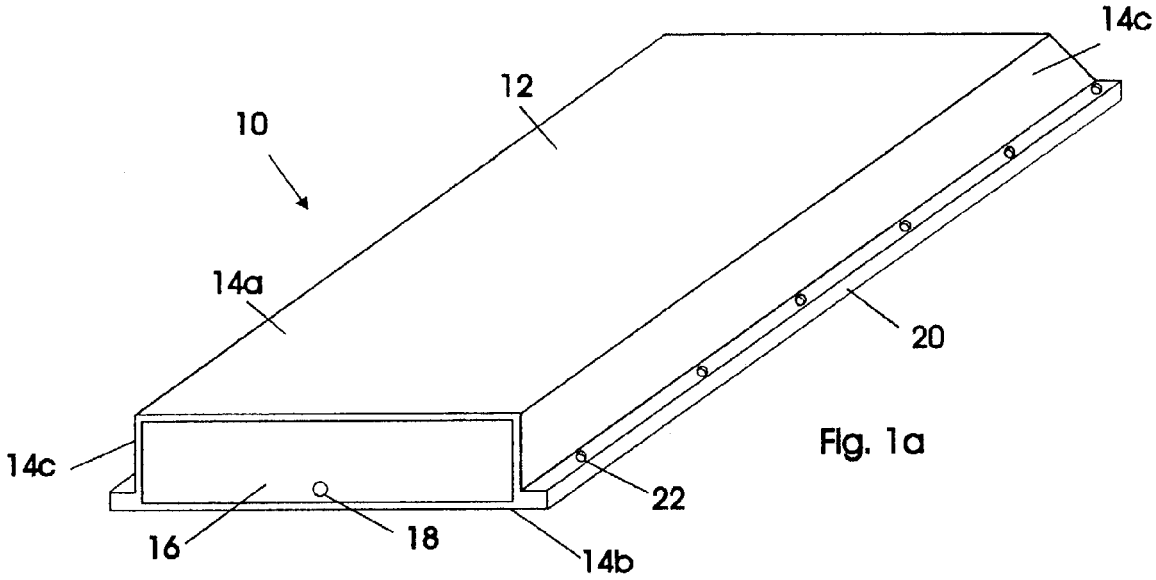
FIG. 1*a* is a perspective view of the box assembly of the multi-purpose storage device of the present invention.

With reference to the drawings, in particular to FIGS. 1–6*b* thereof, the present invention, a multi-purpose storage, denoted by reference numeral 10 will be described. Shown is a multi-purpose storage device apparatus 10 that is designed and configured to receive and store a conventional ladder, tools, guns, fishing poles or any elongated object. The present invention is ideally suited for attachment to a vehicle, such a truck or the like, thereby providing an assembly that is versatile and one that can be utilized and enjoyed by hunters, contractors, home owners or the like, for adequately and efficiently storing, maintaining and protecting the items housed therein. Hence the present invention will be attached to a vehicle and enabled the user to transport items easily, conveniently and efficiently.

Figure 1B:
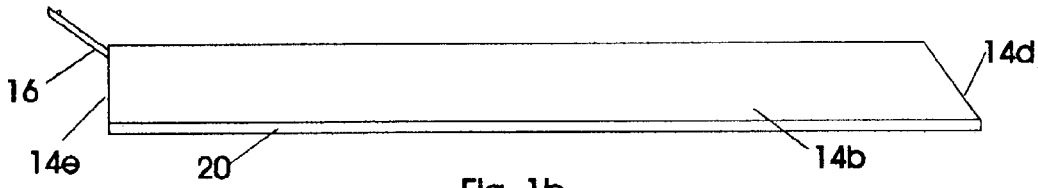
FIG. 1*b* is a side view of the box assembly of the multi-purpose storage device of the present invention.
Figure 1C:
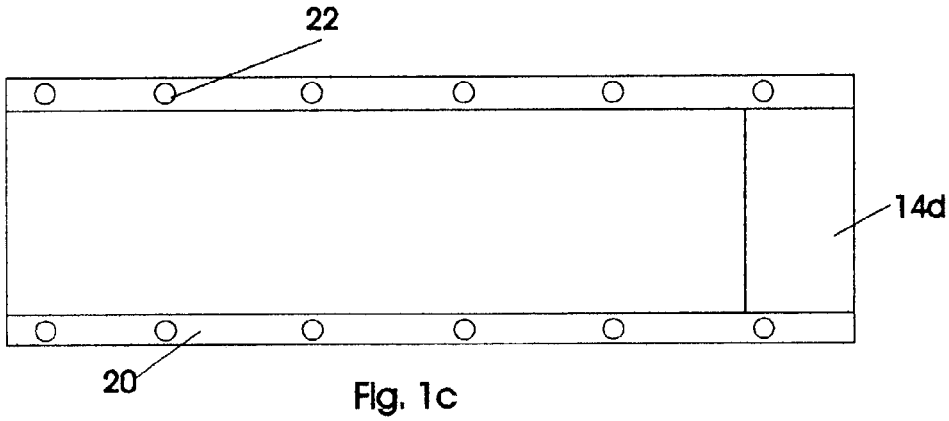
FIG. 1*c* is a top view of the box assembly of the multi-purpose storage device of the present invention.

In order to provide for such a device, the present invention 10, as seen in FIGS. 1*a*–1*c* includes a box assembly 12 having an upper wall 14*a*, lower wall 14*b*, side walls 14*c*, front wall 14*d* and rear wall 14*e*. Together, the walls form a box assembly 12 that includes an interior area that will receive and maintain a ladder. Access to the interior area occurs via a door 16 that can be locate on either the front wall or rear wall 14*e* (as illustrated). The wall can constitute as a door, or optional, as illustrated, a separate door can be utilized. For aiding in the use of the door, a handle 18 can be located thereon. For preventing thief, a conventional lock or the like can be attached thereto.

Extending outwardly from the outer edges of the lower wall 14*b* is a flange member 20. This provides for the flange member 20 to be located to each side wall of the box assembly 12 so as to provide for the flange 20 to be parallel to each side wall. Hence providing for two flanges, which innately form a lip. Extending through this lip is a plurality of apertures 22. The apertures. 22 are adapted to receive conventional attaching elements such as screws or the like. Consequently providing for the flanges 20, apertures 22 and attaching elements to inherently form the attaching device for enabling the present invention to be attached to any desired surface, such as the upper edge of a truck's bed, a frame secured on a truck or the like.

To decrease wind resistance, such as when the present invention is attached to a truck or the like, and the vehicle is in motion, the front wall 14*d* is angularly attached. This arrangement will provide for front wall to be angularly disposed from the top wall to the bottom wall.

It is noted that this present invention can accommodate any conventional ladder and/or elongated object. If it is desirable to provide for a snug fit of the stored item, foam can be inserted therein. For example, if a ladder is stored therein and the ladder is seven feet in length, and the storage area is ten feet in length, then foam or other durable and rigid material, can be inserted therein for preventing movement of the stored item.

Figure 2:
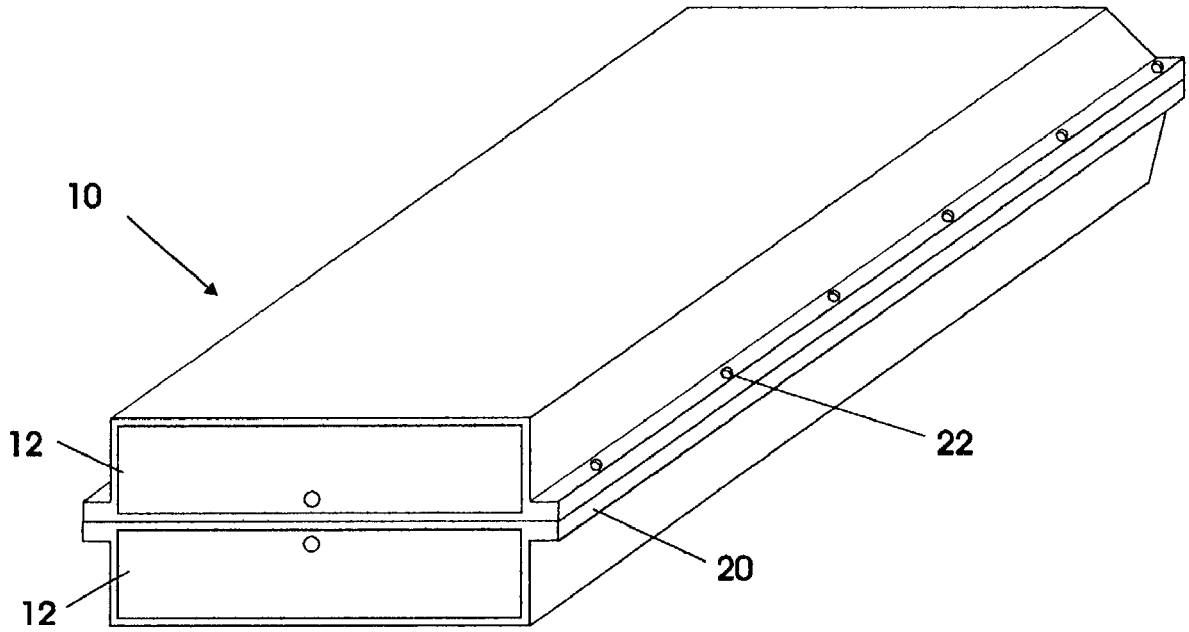
FIG. 2 is perspective view of a pair of box assemblies in a stacked position.

For those who have a multiple amount of ladders or elongated items, a pair of box assemblies 12 of the present invention, as seen in FIG. 2 can be stacked and secured to for intrinsically providing a multiple of units. To provide for such a configuration, the bottom wall of each unit is placed in contact with one another. The apertures 22 of the flanges 20 are aligned. Once aligned, screws or the like are inserted therein for enabling the units to be secured to each other. Thereby rendering an increase in storage capability. Alternatively, these apertures can be aligned to apertures located on the edge of the bed of a truck. The securing device, such as a screw, can extend from the aligned apertures 22 of the flange into the aperture located in the truck for rending the stacked units to be secured thereto.

Figure 3A:
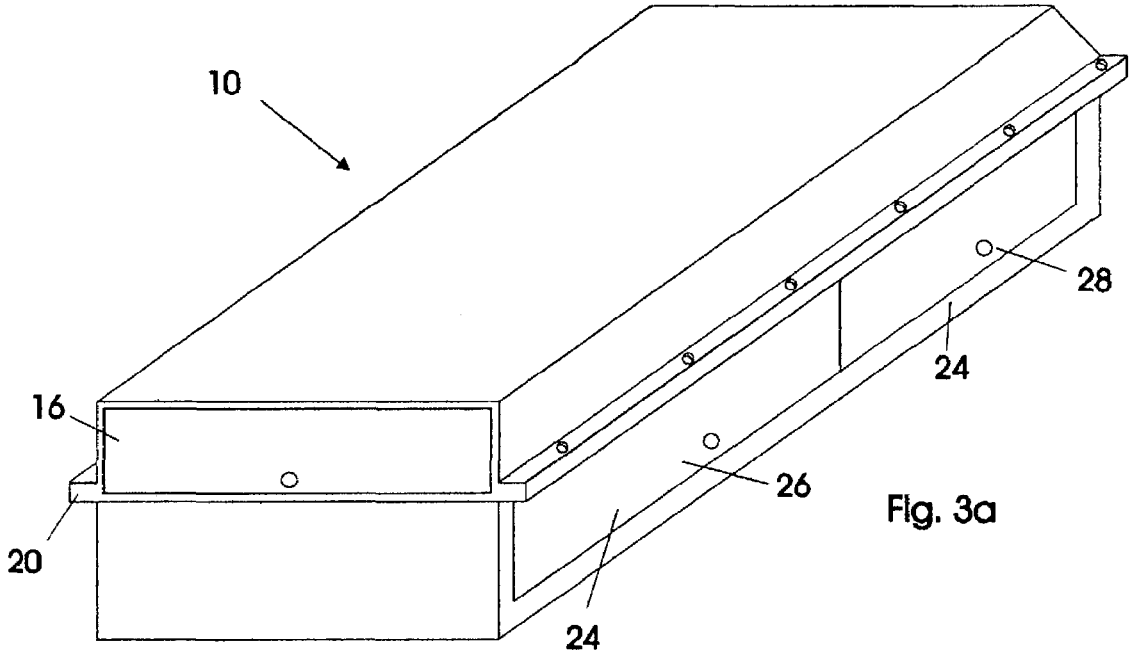
FIG. 3*a* is a perspective view illustrating an alternative embodiment of the multi-purpose storage device of the present invention including a plurality of compartments attached to the box assembly.
Figure 3B:
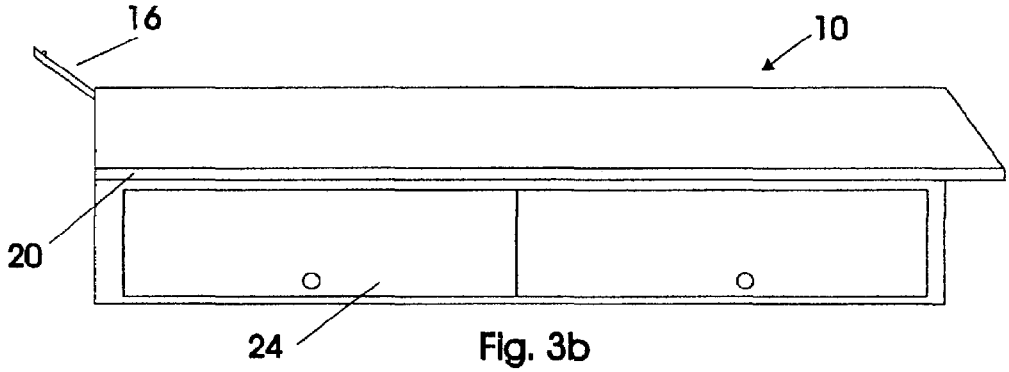
FIG. 3*b* is a side view illustrating an alternative embodiment of the multi-purpose storage device of the present invention including a plurality of compartments attached to the box assembly.
Figure 3C:
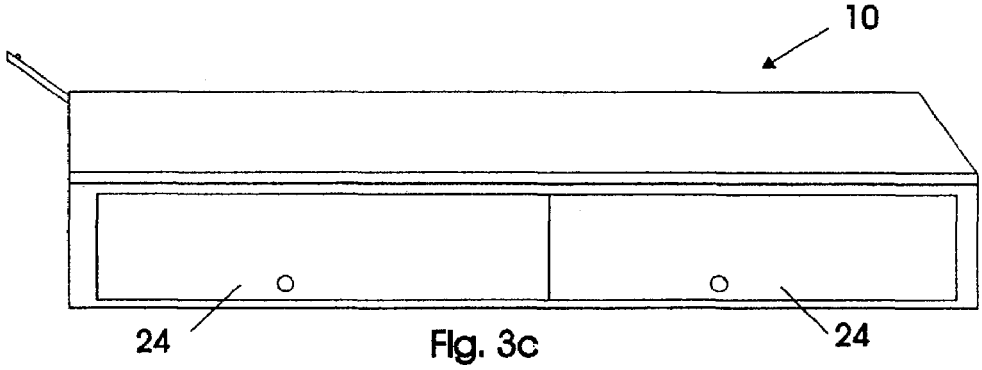
FIG. 3*c* is a side view illustrating an alternative embodiment of the multi-purpose storage device of the present invention including a plurality of compartments attached to the box assembly.

Other features can be added to enhance the storage device 10 of the present invention. One feature that can be added is the use of at least one additional compartment or container 24 to the box assembly 12. As seen in FIGS. 3*a*–3*b*, the compartment(s) are secured to the lower wall 14*b* of the box assembly 12. This will provide for a device having a separate storage facility for the elongated object and separate compartments for other objects, such as tools, gear or the like. As shown, each compartment includes access means, such as a door 26 and handling capability, such as the use of a handle 28. Each compartment can include a conventional lock secured thereto. The access means can be located on any accessible wall of the particular compartment. Thus, providing for the door to be accessible via a side wall (as shown), a top wall (see FIG. 4*a*), front wall, rear wall (see FIG. 4*b*), or bottom wall.

As seen in FIGS. 3*a*–3*b*, the compartments are non-obtrusive in regards to the flange 20, thereby providing for the flange to be free of obstruction and thus enable attachment to commence as discussed above. In addition, the compartment(s) can partially extend the length of the box assembly (see FIG. 3*b*) or optionally, can extend substantially the entire length of the box assembly (see FIG. 3*c*).

Figure 4A:
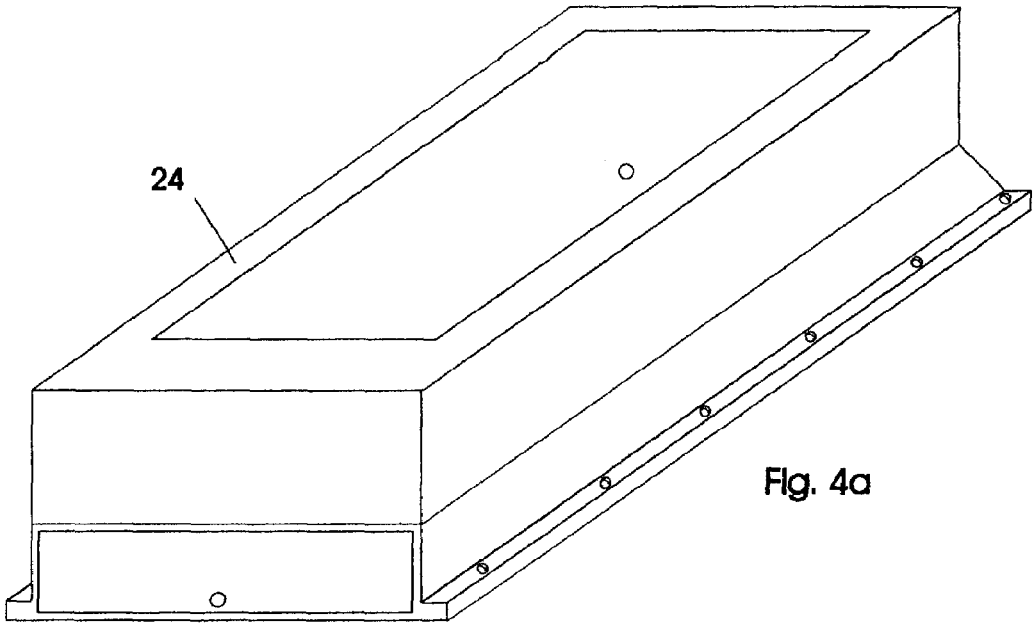
FIG. 4*a* and FIG. 4*b* are perspective views illustrating an alternative arrangement for the compartment(s) used with the box assembly of the multi-purpose storage device of the present invention.
Figure 4B:
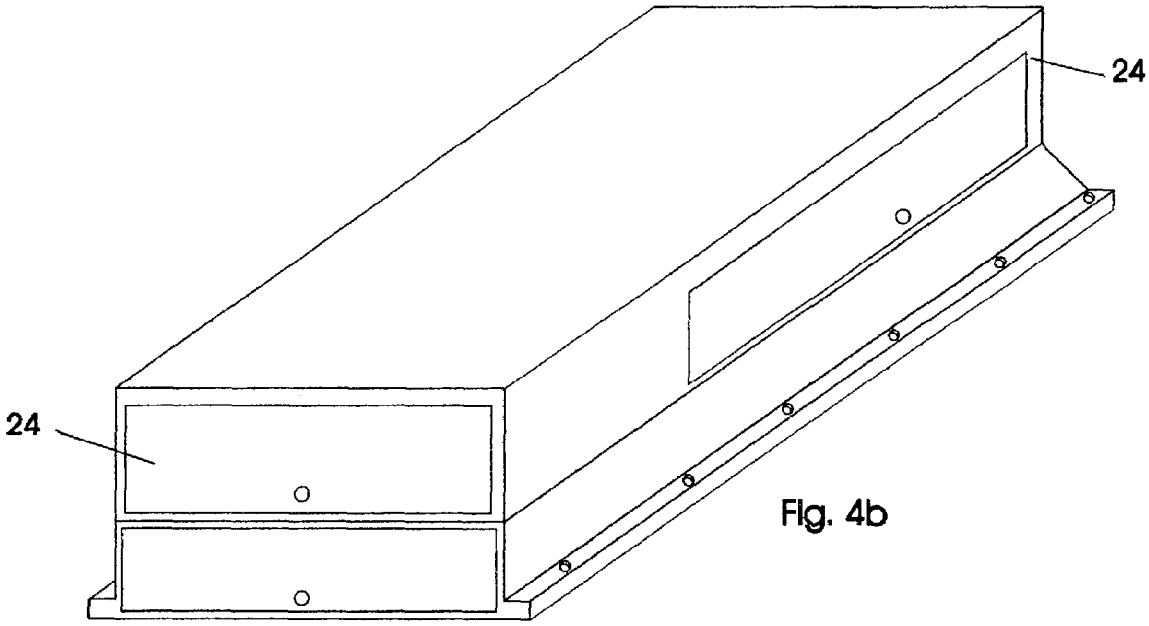

Alternatively, as seen in FIGS. 4*a* and 4*b*, the at least one compartment 24 can be located above the box assembly 12, thereby providing for the at least one compartment 24 to be secured to the upper wall. This arrangement will still provide access to the flange and prevent obstruction from the plurality of apertures.

Figure 5:
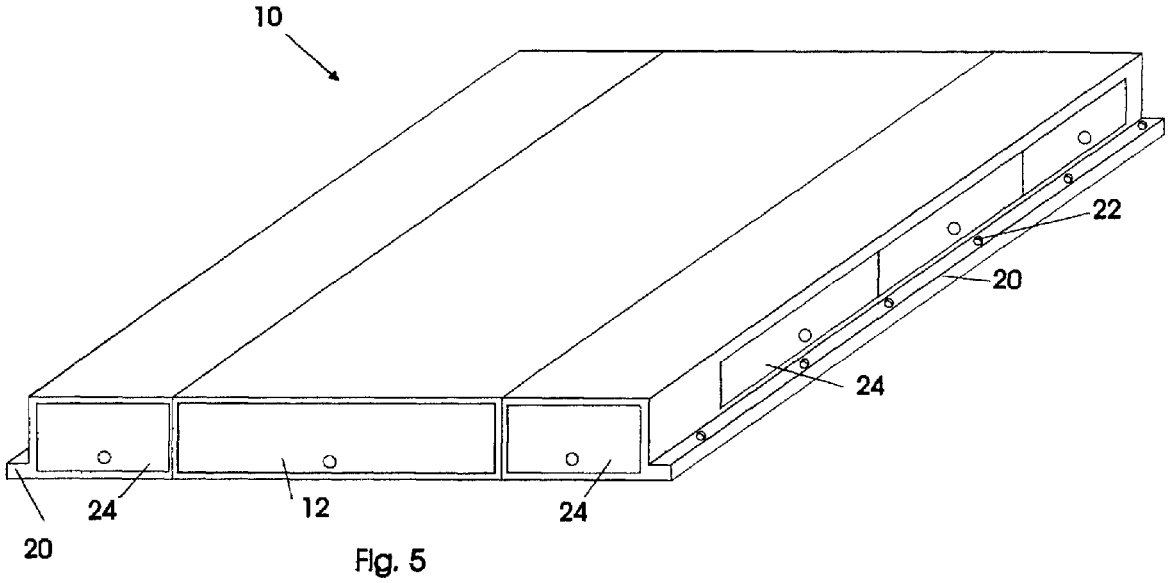
FIG. 5 is a perspective view illustrating an alternative embodiment of the multi-purpose storage device of the present invention including a plurality of compartments attached to the side of the box assembly and the compartments including a flange secured thereto.

The compartment(s) 24 can be secured to the side wall(s) of the box assembly 12, as shown in FIG. 5. In this configuration, the compartment(s) that are secured to the side wall would include is at least one compartment or container can be located on above, below or on the side of the box assembly.

It is noted that at least two compartments can be utilized and the at least two compartments can be secured to any two separate walls (see FIG. 5). For example compartments can be secured to both the upper wall and lower wall. Alternatively, compartments can be located on the upper wall and at least one side wall.

When the compartment or container is located on the side(s) of the box assembly, as shown in FIG. 5, then the side compartment(s) will include the flange 20 having the plurality of apertures 22 for inherently providing for the final product to include outer side walls having a lip secured thereto.

Figure 6A:
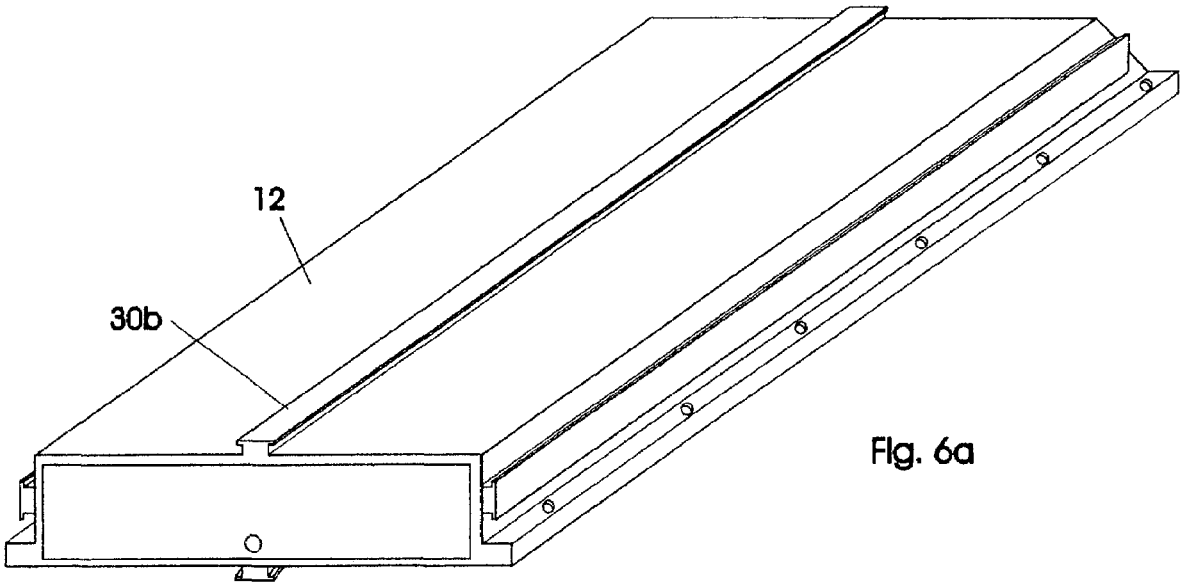
FIG. 6*a* is a perspective view of the box assembly of the present invention illustrating an example of an attaching device that can be used to removably receive a compartment.
Figure 6B:
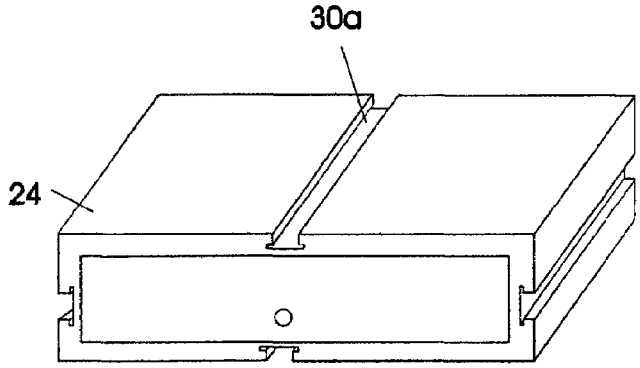
FIG. 6*b* is a perspective view of a compartment of the present invention illustrating an example of an attaching device that can be used to removably attach the compartment to the box assembly.

Alternatively, a plurality of compartments can be provided so as to provide for each compartment to be removably secured to a desired wall of the box assembly 12. As seen in FIGS. 6*a* and 6*b*, in this arrangement each container 24 will include a removably attaching device 30*a* that corresponds to an attaching device 30*b* located on the upper wall, side walls and/or lower wall. The attaching device 30*a* and 30*b* can be any conventional feature. As seen, the attaching device 30*b* for the box assembly 12 includes a projection 32 having a T-shape. As seen, the upper wall, bottom wall and side walls each include the projection 32. This projection 32 is designed and configured to slide into channel 34 of the compartment 24. As seen in FIG. 6*b*, the channel has an inverted T-shape that will correspond to the projection 32. This will provide for the container to slide onto the projection of the box assembly 12. As seen, the upper wall, bottom wall and side walls each include the channel.

It is noted that if the container is to be located on the side walls, as least two oppositely located apertures must be accessible in order to enable the present invention to be attached to a desired surface. Due to the varying sizes of the container, the user can customized the device as deemed necessary.

In order to utilize the present invention, such as the embodiment illustrated in FIGS. 1*a*–1*c*, the user secures the box assembly to the desired surface, such as the edge of the bed of a truck. The front wall or angled wall should face the front of the vehicle. Once secured, the access is used to provide access to the interior. The desired item to be stored therein, such as a ladder is placed therein. If a snug fit is desire, foam or the like is place therein for obtaining the desire fit. When located therein, the access is closed and if provided, locked.

In order to utilize the present invention, such as the embodiments illustrated in FIGS. 3*a*–5, the user secures the device to the desire surface via the apertures located on the flange. The items desired to be stored are placed in their respective container. When located therein, the access of each compartment is closed and if provided locked.

In order to utilize the present invention, such as the embodiments illustrated in FIGS. 6*a* and 6*b*, the user places the desired compartments at the desired located on the storage box 12. Once located thereon, the device is secured to the desired surge via the use of the securing devices inserted into the apertures located in the flange. When located therein, the access is closed and if provided locked.

Figure 7:
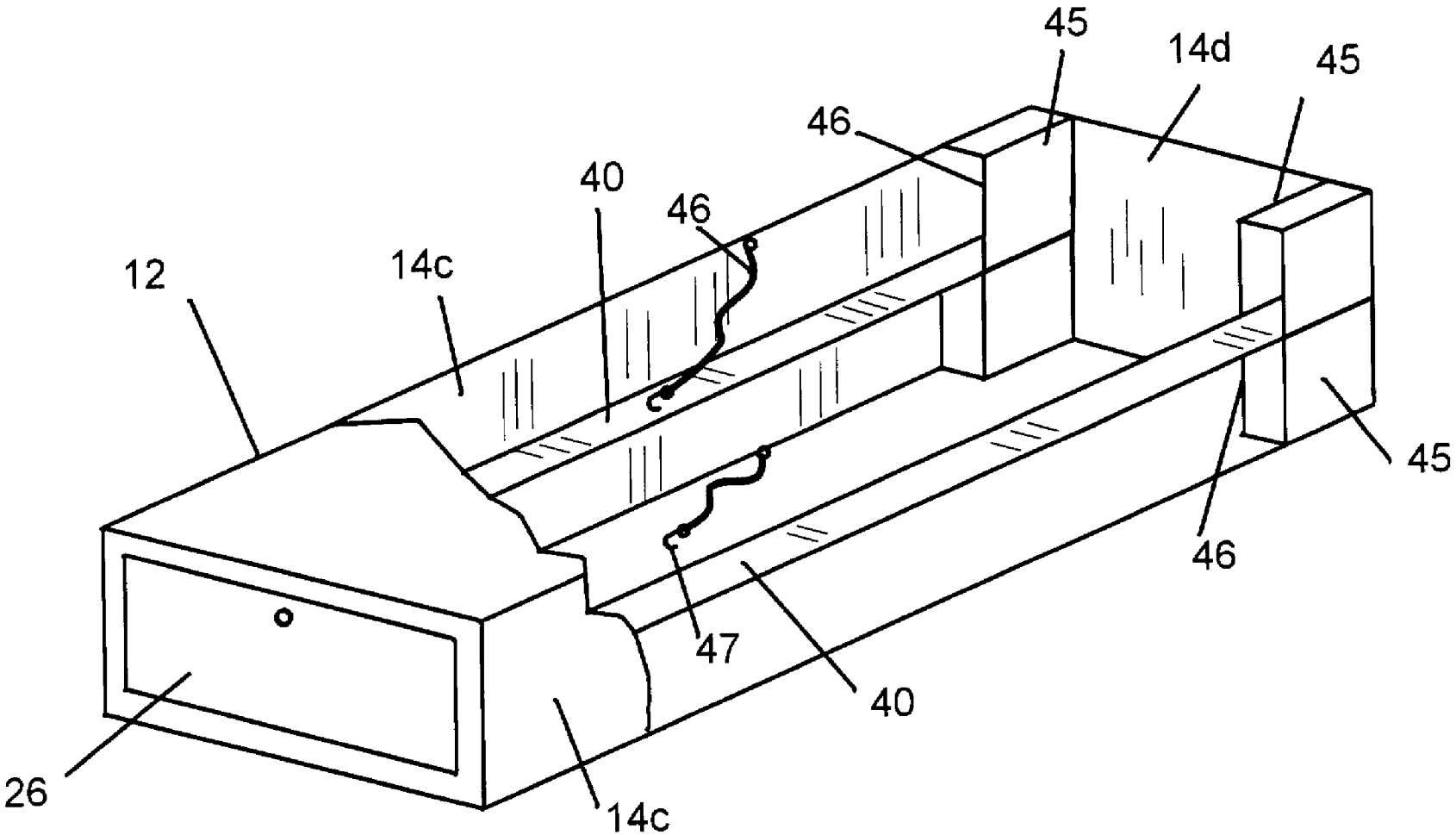
FIG. 7 is a perspective view of an alternative embodiment of the invention including elements to maintain placement of ladders within a storage box.

FIG. 7 is a perspective view of an embodiment of the present invention including features to further restrain a ladder within a storage box—the outer walls of the box are partially cut away in the figure to enable viewing of the internal structures. A box assembly 12 includes inner rails 40 for guiding a ladder during insertion and removal of the ladder from the box. The rails extend in pairs inwardly from opposing side walls 14*c* of the box assembly. The rails are preferably formed of sheet metal of sufficient thickness to provide the required stiffness for the functions herein detailed. The rails have a width—extent perpendicular from the adjacent side walls 14*c*—adequate to support the foot ends of a standard ladder. Because the distance between various ladders' foot ends may vary, as well as the foot end size, both the box width (distance between opposing side walls 14*c*) and the rail width may be selected to accommodate these differences. Preferably, the rail width dimension is in the range of three to five inches. The rails preferably are continuous along the length of the box assembly 12, from a box access door 26 to a relatively opposing front wall 14*d*. At the front wall 14*d* each rail 40 terminates at a foot bracket 45. Each foot bracket 45 is defined by a retaining wall 46 spaced from the adjacent side walls 14*c* and extending parallel to the rail 40. Preferably the retaining wall extends from the front wall 14*d* a length of at least four inches. The foot bracket 45 is a means of capturing and laterally securing a ladder foot end once a ladder has been introduced to the box assembly 12 and positioned with the ladder foot proximate the front wall 14*d*. In use, the rail 40 guides a ladder foot end to the bracket 45. The height (relative to the figure) of the bracket is not critical and is preferably oversized with respect to the particular ladder to be stored. A height dimension of six inches is sufficient for most uses. The orthogonal width of the bracket 45 preferably matches that of the rail 40.

The brackets 45 may be provided alone without associated rail 40 and still provide the function of laterally support to ladder foot ends. Both the rails and foot ends provide function and benefit in a box assembly 12 that is installed and used in alternative orientations. For example, in a orientation in which the box assembly 12 is turned 90 degrees about its long axis, the rails extending upwardly and downwardly, respectively, from the then lower and upper side walls 14*c*. In this orientation, the rails provide separation of the individual ladders and the brackets assist in securing the ladder position.

In the embodiment shown in FIG. 7, two sets of brackets are provided to receive and secure two ladders. The rails 40 aid in separation during storage and removal. In like manner, alternative embodiments include additional sets of rails with associated brackets 45 to accommodate additional ladders. Three or more ladders may be so stored in such a single box assembly 12. In other alternatives, one or more ladders are separated from non-ladder storage space by similar use of rails and brackets.

The present box assemblies are contemplated to be used on moving vehicles on which shifting of stored tools is a known problem. To ensure that stored ladders are retained with the foot ends in the brackets 45 it is preferred to provide a means of biasing the ladders toward the brackets and front wall 14*d*. Such means should allow easy entry of the ladder to the box. In FIG. 7, a elastic cord 46 is shown secured to the box assembly 12 and terminating in a hook 47. In operation, after a ladder is introduced to the box, the cord is stretched toward the door 26 to create tension and the hook 47 then secured to a ladder rung or other ladder structure. The cord tension provides the biasing means to ensure that the ladder foot ends remain within the brackets 45. Other similar biasing means providing the same function will be obvious to one skilled in the art.

While the invention has been particularly shown and described with reference to an embodiment thereof, it will be understood by those skilled in the art that various changes in from and detail may be made without departing from the spirit and scope of the invention.

I claim:

1. A ladder storage device comprising:

a) a box assembly defining an interior area and having an access and an opposing front wall, and two mutually opposing side walls;

b) a rail extending perpendicularly from each side wall and into the interior area;

c) a bracket associated with each rail and proximate the front wall wherein each bracket comprises a retaining wall extending from the front wall and spaced from the side wall;

d) the box assembly configured to accept a ladder into the interior area to be secured within the brackets;

e) means for biasing the ladder towards the front wall via an elastic cord;

f) at least one storage compartment removably secured to the box assembly; and g) a locking device for locking the access.

* * * * *